US005505147A

United States Patent [19]

Forte et al.

[11] Patent Number: 5,505,147

[45] Date of Patent: Apr. 9, 1996

[54] LATCH TAKING KNIFE AND THREAD CLAMP

[75] Inventors: Anthony D. Forte, Chicago; Robert K. Westbrook, McHenry; Robert Briggs, Antioch, all of Ill.

[73] Assignee: Union Special Corporation, Huntley, Ill.

[21] Appl. No.: 394,002

[22] Filed: Feb. 24, 1995

[51] Int. Cl.[6] ..... D05B 29/12; D05B 65/00

[52] U.S. Cl. ..... 112/235; 112/288

[58] Field of Search ..... 112/288, 197, 112/235, 139, 302

[56] References Cited

U.S. PATENT DOCUMENTS

| | | | |
|---|---|---|---|
| 2,394,873 | 2/1946 | Prall | 112/139 |
| 3,304,896 | 2/1967 | Laidig | 112/235 |
| 4,040,370 | 8/1977 | Maforio | 112/302 |
| 4,072,116 | 2/1978 | Nagy | 112/288 |
| 4,526,113 | 7/1985 | Angele | 112/235 X |
| 4,532,874 | 8/1985 | Eguchi et al. | 112/235 |

FOREIGN PATENT DOCUMENTS

| | | | |
|---|---|---|---|
| 2068423 | 8/1981 | United Kingdom | 112/235 |

OTHER PUBLICATIONS

"Walker Back Tacker"; p. 618; Dunlap Sales, Inc. Catalogue, 1991.

"Model AP–26S Backlatch"; p. 343.

"Model AP–26S Backlatch"; p. 13 of Atlanta Attachment Company's Exhibition Catalog 91/92.

*Primary Examiner*—Ismael Izaguirre

*Attorney, Agent, or Firm*—Willian Brinks Hofer Gilson & Lione

[57] ABSTRACT

A mechanical latch tacking device carried by the toe of the sewing machine presser foot that will allow the operator to produce a relatively short stitch chain at the end of a seam and in a single smooth ergonomical motion cause the chain to be severed and the end of the chain that extends from the needle retained in a location where the next workpiece is started the retained chain will be sewn into the seam.

20 Claims, 2 Drawing Sheets

LATCH TAKING KNIFE AND THREAD CLAMP

BACKGROUND OF THE INVENTION

The present invention was developed for use with an overedge sewing machine but could be used with any type of machine in which a chain is produced after the completion of a seam; and, it is desired to cut the chain, retain the cut end of the chain that leads back to the needle and to sew the retained chain end into the next seam.

A device carried by the presser foot of a sewing machine for severing a chain of stitches extending between a sewn workpiece and the needle of the machine, retaining the severed end of the chain that extends from the needle and guiding the retained chain such that it is incorporated into the seam of stitches formed in the following workpiece is shown in U.S. Pat. No. 4,040,370. The device of this prior art patent is difficult for an operator to use and thus requires a relatively long time period to complete the operation. In this prior art device, after completing a stitching operation on a workpiece, the operator must slide the sewn workpiece along the bevel 23 and must then cause the chain to enter the slot 16. The patent implies that the bevel 23 in some way assists the operator in causing the chain to enter the slot 16; however, the patent does not explain how this assistance is provided. The bevel 23 is parallel to slot 16 and it is apparent that after the operator slides the workpiece along bevel 23, the operator must then reverse the direction of the workpiece a full 180° and index it to the side if the chain is to enter the slot 16. After getting the chain to the slot 16, the operator must then insert the chain beneath the leaf spring 19 which grips the chain. The portion of the chain that extends from where it is gripped by leaf spring 19 to the workpiece is then drawn by the operator toward the blade 21 where it is cut. Thus, the operator must manipulate the workpiece and connected chain in a stop and start maze-like pattern to complete the desired operation.

Not only is the use of this prior art device time consuming it is not ergonomically sound. Commercial sewing machine operators perform operations such as cutting a stitch chain and incorporating the retained chain in the next seam thousands of times in an eight hour work day. When the pattern of movement that an operator's hand must follow to perform the task is awkward and tortious as it is in the above prior art device, it can result in physical problems, such as carpal tunnel syndrome, to the operator who must perform the operation thousands of times each work day.

The thread used to produce the chain between successive workpieces is wasted material and thus cost savings can be realized by minimizing the length of chain. The commercially available devices that are available to cut the chain and retain the cut end so that it can be sewn into the next seam require relatively long chain lengths and thus add unnecessary cost to the finished product.

For the foregoing reasons there is a need for an ergonomically sound apparatus that will allow a sewing machine operator to produce a relatively short stitch chain at the end of a seam and in a single smooth motion cause the chain to be severed and the end of the chain that extends from the needle retained and guided into the next seam.

SUMMARY OF THE INVENTION

The present invention is directed to an apparatus that will permit a sewing machine operator to produce a stitch chain of a minimum length at the end of a seam and in a single smooth ergonomic motion cause the chain to be severed and the end of the chain that extends from the needle retained and guided into the next seam.

This invention can be used in sewing machines that produce an overedge, for example stitch type 504 as defined in the United States Government Specification Booklet 751a. The class 39500 machine produced by Union Special Corporation is a commercially available machine that can produce the type 504 stitch. Reference is hereby made to co-pending U.S. patent application, Ser. No. 08/273,774, now U.S. Pat. No. 5,465,674, for a disclosure of an overedge stitch sewing machine.

The apparatus of this invention requires a chain length of about one inch which reduces the cost of the finished product by minimizing waste which does not add to the value of the finished product. Furthermore, the sewing machine operator can in a single smooth sweeping movement cause the chain to be cut and the end retained in a position where it will be sewn into the next seam. This operation can be performed very quickly and in an ergonomically sound manner. Another advantage of this invention is that the presser foot can be raised and lowered while the chain end is being retained without the chain end being pulled from the chain clamp.

The present invention is directed to an apparatus consisting of a presser foot having a forward upwardly turned toe, the bottom surface of which functions to guide the chain to the chain cutter and retainer.

The present invention is also directed to an apparatus consisting of a knife holder member that is mounted on said presser foot rearwardly of said upwardly turned toe that includes a flat vertical chain gripping surface that merges into a vertical flared surface that is forward of said first flat vertical chain gripping surface.

The present invention is directed to an apparatus consisting of a chain clamping member including a flat vertical chain gripping surface and a flared portion that extends forward of its flat vertical chain gripping surface and flares outwardly therefrom.

The present invention is directed to an apparatus consisting of a biasing device for urging the chain clamping member toward the knife holder such that the flat vertical chain gripping surface are biased into engagement with each other.

The present invention is furthermore directed to an apparatus consisting of a chain cutting knife that is carried by the knife holder such that it extends across the upper horizontal edges of the chain gripping surfaces.

For the foregoing reasons there is a need for an apparatus that will allow a sewing machine operator to produce a relatively short chain at the end of a seam and in a single smooth motion cause the chain to be severed and the end of the chain that extends from the needle retained and guided into the next seam.

BRIEF DESCRIPTION OF THE DRAWINGS

The drawings show an embodiment of the invention which will be described with reference to the drawings in which.

DETAILED DESCRIPTION OF THE PREFERRED EMBODIMENT

Figure 1:
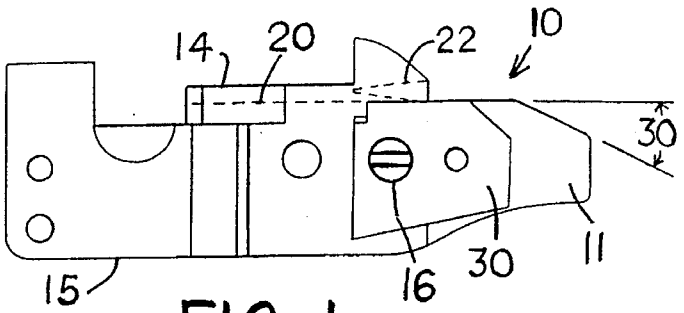
FIG. 1 is a plan view of the presser foot with only the knife holder mounted thereon.

FIG. 1 is a plan view of the presser foot 10 with the knife holder or first chain gripping member 30 secured thereto by a screw 16. The presser foot 10 has a forward upturned toe portion 11. The surface 12 of the presser foot 10 has been formed by cutting away the corner of the upturned toe portion 11 at an angle of about 30 degrees to the line of feed such that surface 12 flares away from the line of feed and can function to guide the chain between the chain clamping surfaces. When making an overedge stitch, the fabric trimming knife trims the edge of the fabric such that the trimmed edge lies along edge 14 of the presser foot. The other longitudinal edge of the presser foot is identified as edge 15. A portion of the bottom surface of the presser foot 10, seen as a broken line 20 in this view, has been removed and a radius 22, also seen as broken lines in this view, has been cut into the bottom surface. The radius 22 is in alignment with the needle. The removed portion forms a surface that is elevated from the presser foot bottom surface and thus creates a space or cavity for receiving and containing the retained chain as a subsequent workpiece is being stitched.

Figure 3:
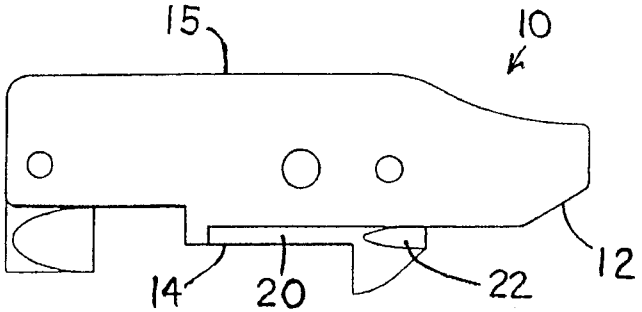
FIG. 3 is a bottom view of the presser foot.

The bottom surface of the presser foot is illustrated in FIG. 3. In this view the portion 20 of the bottom surface that has been removed and the radius 22 are seen in full lines.

Figure 2:
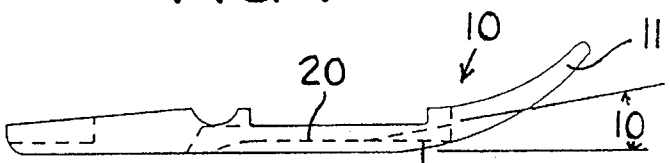
FIG. 2 is a side view of the presser foot.

In the side view, FIG. 2, it is apparent that the radius 22 is at an angle of about 10 degrees to the horizonal and will function to align the cut chain with the needle. This view is helpful to visualize how the retained chain will be properly aligned with the needle and will be sewn into the initial portion of the successive seam.

Figure 4:
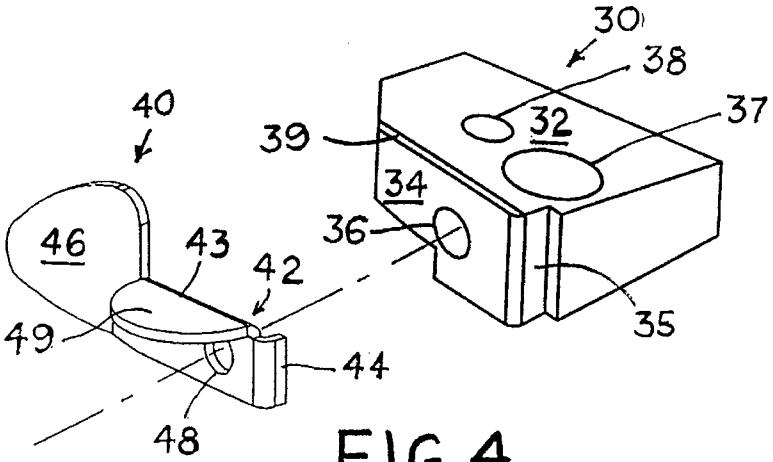
FIG. 4 is an exploded perspective view of the knife holder and chain clamp.
Figure 5:
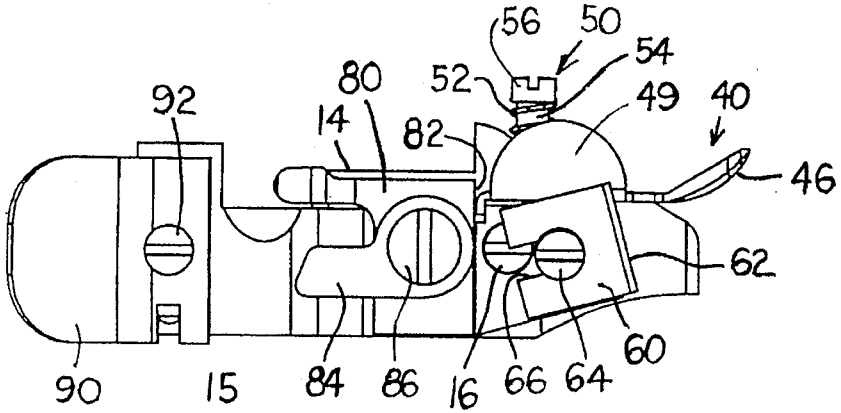
FIG. 5 is a plan view of the presser foot with the chain cutting and retaining apparatus mounted thereon.

In the perspective view of the knife holder 30 and chain clamp 40 seen in FIG. 4, the top surface 32 of the knife holder 30 is shown as flat and at an angle of about 10° to the horizontal. Thus, the height of the knife holder 30 is greatest at the intersection 39 which is a substantially horizontal edge of the top surface 32 with the first flat vertical chain gripping surface 34. A notch 35 is cut into the corner of the knife holder 30 for the reception of the pivot arm 44 of the chain clamp 40. A threaded hole 36 is formed in the flat vertical chain gripping surface 34 for the reception of the spring screw 50 which is a component of the biasing device that functions to force the chain clamp 40 against the knife holder 30. A bore 37 is formed in the top surface 32 for the reception of screw 16 that secures the knife holder 30 to the presser foot 10. A threaded hole 38 is formed in the top surface 32 for the reception of the knife screw 64 that secures the knife 60 to the top surface 32 of the knife holder 30.

The chain clamp 40, is shown in FIG. 4, is spaced away from its position on the knife holder 30 to better illustrate the knife holder 30. The substantially horizontal upper edge 43 of the flat vertical chain gripping surface can be seen in FIG. 4, however only the back surface of the flat vertical chain gripping surface 42 is visible in this view. The pivot arm 44 of the chain clamp 40 and its position relative to the notch 35 of the knife holder 30 is clearly illustrated. The pivot arm 44 extends at a right angle to the flat vertical chain gripping surface 42 and when assembled extends into pivot notch 35 that is formed in the knife holder 30. When the presser foot is fully assembled, the back surface for the notch 35 is formed by the forward edge 82 of the stitch tongue 80. The forward end 46 of the chain clamp 40 is flared out to extend away from its flat vertical chain gripping surface 42. The flared forward end 46 forms with the surface 12 of the presser foot a rearwardly converging guide for the chain. A spring screw aperture 48 is formed in the flat vertical chain gripping surface 42 through which the spring screw 50 freely extends.

Figure 6:
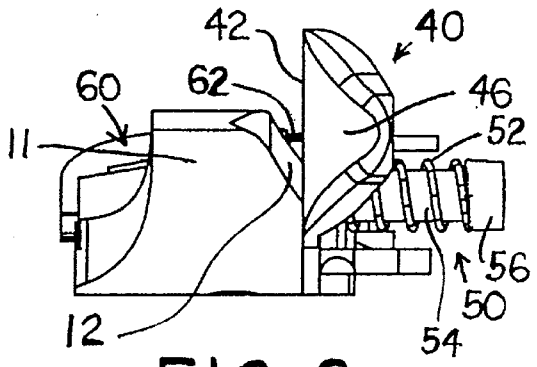
FIG. 6 is a front view of the presser foot with the chain cutting and retaining apparatus mounted thereon.
Figure 7:
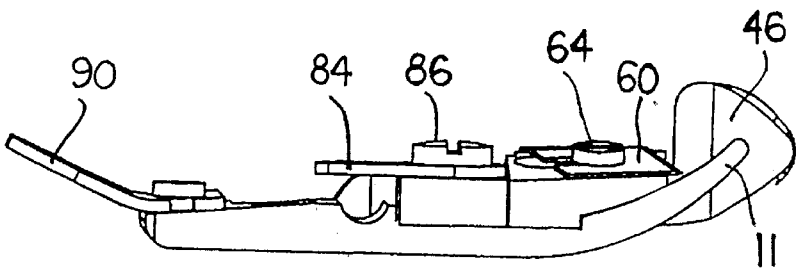
FIG. 7 is a side view of the presser foot with the chain cutting and retaining apparatus mounted thereon.

As is best seen in FIG. 6, a coil spring 52 surrounds the shank of spring screw 50 and utilizes the head 56 of the spring screw as a reaction surface. The shank of the spring screw 50 extends freely through the spring screw aperture 48 of the chain clamp 40 and is threaded into the threaded hole 36 formed in the knife holder 30. When the chain is located between the vertical chain gripping surfaces 34 and 42, the chain clamp 40 pivots away from the knife holder 30 about its pivot arm 44. The spring 52 biases the pivot arm 44 into the notch 35 and thereby confines the chain clamp 40 in its movement. During this pivotal movement, the chain clamp 40 is also guided in its movement by the aperture 48 sliding along the shank 54 of spring screw 50. Thus, the movement of the chain clamp 40 is reliably confined to its intended path. The chain clamp 40 has a semi-circular shaped tab 49 that extends generally horizontal from its upper edge. Tab 49 overlies the coil spring 52 and spring screw 50 to protect the operator from being cut by the knife 60 as well as to prevent loose threads from becoming entangled.

Figure 8:
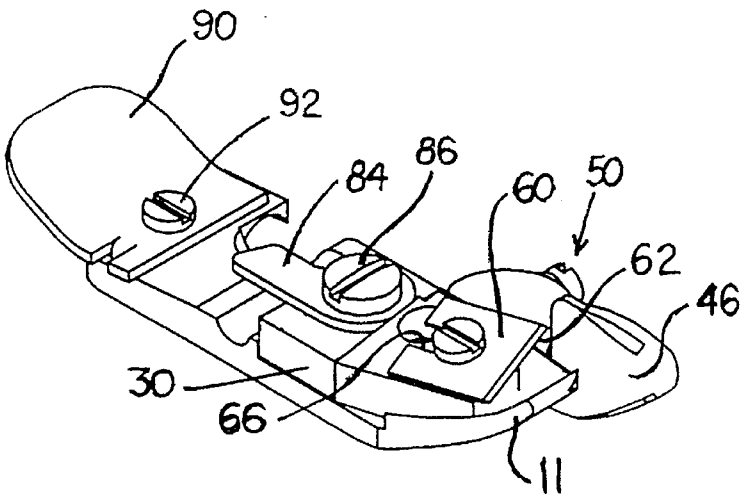
FIG. 8 is a perspective view of the presser foot with the chain cutting and retaining apparatus mounted thereon.

As best seen in FIGS. 6 and 8 knife 60 has a sharpened cutting edge 62 and a mounting slot 66. The knife 60 is secured to the top surface 32 of the knife holder 30 by a knife screw 64 that extends through the slot 66 and is received in the threaded hole 38 formed in the top surface 32 of the knife holder. It should be noted that the top surface 32 is at an angle of about 10 degrees to the horizontal which causes the cutting edge 62 to be at a small angle to the horizontal. It has been found that when the cutting edge 62 is inclined at an angle of about 10° the cutting is improved. This relationship of the cutting edge 62 to the horizontal is best seen in FIG. 6. The converging guide formed by the surface 12 of the presser foot 10 and the forward flared end 46 of the chain clamp 40 is also clearly shown in FIG. 6. The cutting edge 62 of the knife 60 extends across the converging guide at a small angle to the horizontal. The position of the cutting edge 62 relative to the converging chain guide can be adjusted by loosening the knife screw 64, adjusting the position of the knife on the top surface 32 and then tightening the screw 64.

The stitch tongue 80 has a forward edge 82 that forms the rear surface of the pivot notch 35 in which is received the pivot arm 44 of the chain clamp 40. The stitch tongue 80 and hinge plate 84 are secured to the presser foot 10 by a screw 86. A chain shield 90 is secured to the upper rear surface of the presser foot 10 by a screw 92.

An example of how the apparatus of this invention is used will now be described. In an overedging operation, the operator after completing the seam, chains off approximately one inch. The operator then lifts the presser foot, grasp the workpiece, and moves it to the left and to the front of the presser foot. In performing this initial movement the chain slides along the edge 15 of the presser foot and then across the bottom surface of the upturned toe 11. The chain then enters the V-shaped groove formed of surface 12 and the forward flared end 46 of the chain clamp 40. The sweeping movement of the workpiece is then directed upwardly bringing the chain up into the chain clamp and against the cutting edge 62 of the knife 60. As the chain is guided between the flat vertical chain gripping surfaces 34 and 42, it is also being guided into the cavity formed by the radius 22. The operator continues the smooth sweeping movement upward and to the left. This final movement causes the chain to be cut and the separated workpiece is stacked to the left of the operator. Thus, the retained chain extends downward from the flat vertical chain gripping surfaces 34 and 42 into the radius 22 and back to the needle. The next workpiece is then placed under the presser foot and the presser foot is lowered. As the presser foot is lowered onto the work product, the retained chain is contained in the cavity formed by the removed portion 20. The provision of this cavity permits the chain to be easily pulled from the retainer without binding through the cavity and the radius 22 as stitching begins. If it is necessary to raise the presser foot, for example to reposition the workpiece, the chain will return to its original attitude and will not be accidently pulled from the retainer.

While the invention has heretofore been described in detail with particular reference to an illustrated embodiment of the apparatus, it is to be understood that variations, modifications and the use of equivalent mechanisms can be effected without departing from the scope of this invention. It is, therefore, intended that such changes and modifications be covered by the following claims.

What is claimed is:

1. A device for severing the chain on a workpiece formed when chaining off at the completion of a seam, holding the severed end of the chain that extends from the needle, and guiding the chain being held such that it is sewn into the seam formed in the succeeding workpiece wherein the improvement comprises:

a presser foot having a forward upwardly turned toe and a longitudinal edge that extends along the seam being formed;

a first chain gripping member that is fixedly mounted on said presser foot, said first chain gripping member including a first flat vertical chain gripping surface having an upper substantially horizontal edge, said first flat vertical chain gripping surface including a portion that extends forward of the flat surface and flares outwardly to the left as seen when looking in the direction of the workpiece feed;

a second chain gripping member including a second flat vertical chain gripping surface having an upper substantially horizontal edge, said second flat vertical chain gripping surface including a portion that extends forward of the flat surface and flares outwardly in the opposite direction from the flare of said first flat vertical chain gripping surface such that the flares form a chain guide for guiding the chain between the first and second flat vertical chain gripping surfaces;

a biasing device for biasing the second flat vertical chain gripping surface into engagement with the first flat vertical chain gripping surface;

a chain cutting knife carried by said presser foot such that it extends horizontally across the upper substantially horizontal edges of said first and second flat vertical chain gripping surfaces.

2. The invention as set forth in claim 1 wherein said chain cutting knife is an autonomous and independent element that is adjustably secured to said first chain gripping member and is adjustable relative thereto.

3. The invention as set forth in claim 1 wherein said presser foot includes a groove formed in its bottom surface that is aligned with said first and second flat vertical chain gripping surfaces and functions to confine and accommodate the retained chain against the top surface of the succeeding workpiece.

4. The invention as set forth in claim 1 wherein said first chain gripping member has a flat upper surface that includes said upper substantially horizontal edge, said flat upper surface being downwardly inclined to the horizontal from said upper substantially horizontal edge.

5. The invention as set forth in claim 1 wherein said first chain gripping member includes a vertically extending notch and said second chain gripping member includes a pivot arm that is received in said vertically extending notch to form a vertical pivot axis such that said second chain gripping member pivots relative to said first chain gripping member about said substantially vertical pivot axis.

6. The invention as set forth in claim 1 wherein said second chain clamping member has an aperture formed therein between its flared portion and its pivot arm, said biasing device includes a shank having a free end, said shank being mounted in said first chain gripping member, said shank extending through said aperture formed in said second chain gripping member, said shank including a head portion at its free end, a coil spring surrounding said shank and extending between and bearing against said first chain gripping member and said head portion such that said shank functions as a guide for said chain gripping member and said coil spring biases said second chain gripping member into engagement with said first chain gripping member.

7. An overedge stitch control device for severing the chain on a workpiece that is formed when chaining off at the completion of a seam, holding the severed end of the chain that extends to the needle, and guiding the chain being held such that it is sewn into the overedge stitch formed in the succeeding workpiece comprising:

a presser foot having a forward upwardly turned end and a longitudinal edge that extends along the workpiece edge that is being overedged;

a knife holder member that is fixedly mounted on said presser foot, said knife holder member including a first flat vertical chain gripping surface having an upper substantially horizontal edge, said knife holder member including a first vertical flared surface that is forward of said first said flat vertical gripping surface and flares to the left as seen when looking in the direction of the workpiece feed;

a chain clamping member including a second flat vertical chain gripping surface having an upper substantially horizontal edge, said second flat vertical chain gripping surface including a flare portion that extends forward of said second flat surface and flares to the right as seen when looking in the direction of the workpiece feed in the opposite direction from said first vertical flared surface of said first flat vertical chain gripping surface such that the flares form a chain guide for guiding the chain between the first and second flat vertical chain gripping surfaces;

a biasing device for biasing the second flat vertical chain gripping surface of said second chain gripping member into engagement with the first flat vertical chain gripping surface of said first chain gripping member;

a chain cutting knife carried by said knife holder such that it extends horizontally across the upper substantially horizontal edges of said first and second flat vertical chain gripping surfaces.

8. The invention as set forth in claim 7 wherein said chain cutting knife is an autonomous and independent element that is secured to said knife holder such that it is adjustable relative thereto.

9. The invention as set forth in claim 7 wherein said presser foot includes a groove formed in its bottom surface that is aligned with said first and second flat vertical chain gripping surfaces and functions to confine and accommodate the retained chain against the top surface of the succeeding workpiece.

10. The invention as set forth in claim 7 wherein said knife holder has a flat upper surface that includes said upper substantially horizontal edge, said flat upper surface being downwardly inclined to the horizontal from said upper substantially horizontal edge.

11. The invention as set forth in claim 7 wherein said knife holder member includes a vertically extending notch and said chain clamping member includes a pivot arm that is received in said vertically extending notch to form a vertical pivot axis such that said chain clamping member pivots relative to said knife holder member about said substantially vertical pivot axis.

12. The invention as set forth in claim 7 wherein said chain clamping member has an aperture formed therein between its flared portion and its pivot arm, said biasing device includes a shank mounted in said knife holder member and extends through said aperture formed in said chain gripping member, said shank including a head portion at its free end, a coil spring surrounding said shank and extending between and bearing against said chain gripping member and head portion such that said shank functions as a guide for said chain gripping member and said coil spring biases said chain gripping member into engagement with said knife holder.

13. The invention as set forth in claim 12 wherein there is a threaded bore formed in said first flat vertical chain gripping surface and said shank is threaded such that it is threaded into said threaded bore, threading said shank into and out from said threaded bore serving to compress and relieve said coil spring to adjust the biasing pressure.

14. A device for severing the chain on a workpiece that is formed when chaining off at the completion of a seam comprising:

a presser foot having a forward upwardly turned toe;

a knife holder member fixedly mounted on said presser foot rearwardly of said upwardly turned toe, said knife holder member including a first flat vertical chain gripping surface having an upper substantially horizontal edge, said knife holder member including a first vertical flared surface that is forward of said first flat vertical chain gripping surface and flares to the left as seen when looking in the direction of the workpiece feed;

a chain clamping member including a second flat vertical chain gripping surface and an upper substantially horizontal edge, said chain clamping member including a flared portion that extends forward of said second flat vertical chain gripping surface and flares to the right, as seen when looking in the direction of the workpiece feed, in the opposite direction from said first vertical flared surface such that said flares form a chain guide for guiding the chain between the first and second flat vertical chain gripping surfaces;

a biasing device for urging said chain clamping member toward said knife holder member such that said second flat vertical chain gripping surface is biased into engagement with said first flat vertical chain gripping surface;

a chain cutting knife carried by said knife holder such that it extends across the upper substantially horizontal edges of said first and second flat vertical chain gripping surfaces.

15. The invention as set forth in claim 14 wherein said knife holder has a flat upper surface that includes said upper substantially horizontal edge, said flat upper surface being downwardly inclined to the horizontal from said upper substantially horizontal edge.

16. The invention as set forth in claim 14 wherein said knife holder member includes a vertically extending notch and said chain clamping member includes a pivot arm that is received in said vertically extending notch to form a vertical pivot axis such that said chain clamping member pivots relative to said knife holder member about said substantially vertical pivot axis.

17. The invention as set forth in claim 14 wherein said chain clamping member has an aperture formed therein between its flared portion and its pivot arm, said biasing device includes a shank having a free end, said shank mounted in said knife holder member and extends through said aperture formed in said chain gripping member, said shank including a head portion at its free end, a coil spring surrounding said shank and extending between and bearing against said chain gripping member and head portion such that said shank functions as a guide for said chain gripping member and said coil spring biases said chain gripping member into engagement with said knife holder.

18. The invention as set forth in claim 17 wherein there is a threaded bore formed in said first flat vertical chain gripping surface and said shank is threaded such that it is threaded into said threaded bore, threading said shank into and out from said threaded bore serving to compress and relieve said coil spring to adjust the biasing pressure.

19. The invention as set forth in claim 18 wherein said head has an outer surface that is knurled to enable the threading of said shank into and out of said threaded bore.

20. The invention as set forth in claim 14 wherein said presser foot includes a groove formed in its bottom surface that is aligned with said first and second flat vertical chain gripping surfaces and functions to confine and accommodate the retained chain against the top surface of the succeeding workpiece.

* * * * *